United States Patent [19]

Mizuta

[11] Patent Number: 4,720,608

[45] Date of Patent: Jan. 19, 1988

[54] SWITCHING DEVICE HAVING LOCK PLATE

[75] Inventor: Yukio Mizuta, Aichi, Japan

[73] Assignee: Kabushiki Kaisha Tokai Rika Denki Seisakusho, Aichi, Japan

[21] Appl. No.: 901,519

[22] Filed: Aug. 28, 1986

[30] Foreign Application Priority Data

Aug. 29, 1985 [JP] Japan ..... 60-132342

[51] Int. Cl.[4] ..... H01H 9/20

[52] U.S. Cl. ..... 200/5 B; 200/5 E

[58] Field of Search ..... 200/5 E, 5 EA, 5 EB, 200/5 R, 5 B, 5 C, 5 D, 50 C

[56] References Cited

U.S. PATENT DOCUMENTS 3,126,457 3/1964 Jones ..... 200/5 EB 3,626,120 12/1971 Wright ..... 200/5 E X 4,130,744 12/1978 Beecher II, et al. ..... 200/5 E X 4,508,944 4/1985 Yashima et al. ..... 200/5 E X

*Primary Examiner*—J. R. Scott

*Attorney, Agent, or Firm*—Finnegan, Henderson Farabow, Garrett and Dunner

[57] ABSTRACT

A switching device equipped with a plurality of operating elements has one of the operating elements installed in the switching device pressed in a direction different from the direction in which the other elements are pressed and a single lock plate provided with a counter part formed on each operating element to hold the operating element in the depressed state and releasing its hold based on the operation of pressing the operating element. The lock plate allows depression of only one operating element a time.

1 Claim, 6 Drawing Figures

SWITCHING DEVICE HAVING LOCK PLATE

BACKGROUND OF THE INVENTION

This invention relates to a switching device equipped with a plurality of elements operating when pressed.

A switching device of the sort above mentioned has been composed of a plurality of operating elements lined up in such a manner that they can be pressed down unidirectionally. Consequently, the switching device tends to become lengthy in the direction in which the elements are lined up when the number of them is increased to make the device multifunctional. Since such a lengthy body is hardly containable in a relatively small space, e.g., an instrument board of a motor vehicle, each operating element has to be small-sized at the sacrifice of operability when it is designed for the purpose. Another problem is that some of the operating elements, depending on the state in which the switching device is installed, are not readily operable since the elements are operated unidirectionally and this restricts satisfactory improvement in operability.

BRIEF SUMMARY OF THE INVENTION

An object of the present invention is to provide a switching device whose whole body can be made compact without reducing the size of each operating element installed therein even if a number of operating elements are installed and whose operability can substantially be improved.

The switching device according to the present invention is characterized in that one of the operating elements installed therein can be pressed in a direction different from the direction in which the other elements are pressed down and that a single lock plate normally unidirectionally energized is provided with a plurality of mating means, each selectively mating with a counterpart means formed on each operating element to hold the operating element in the depressed state and releasing its hold when moved in the de-energizing direction based on the operation of pressing the above operating element, whereby the operating elements are prevented from not only lining up but also becoming lengthy and, depending on the arrangement thereof, can be so designed as to operate in suitable directions, respectively.

BRIEF DESCRIPTION OF THE DRAWINGS

The accompanying drawings illustrative an embodiment of the present invention.

DETAILED DESCRIPTION

Referring now to the accompanying drawings, a description will be given of an embodiment of the present invention adapted for a wiper switch arranged on an instrument board of a motor vehicle.

Figure 1:
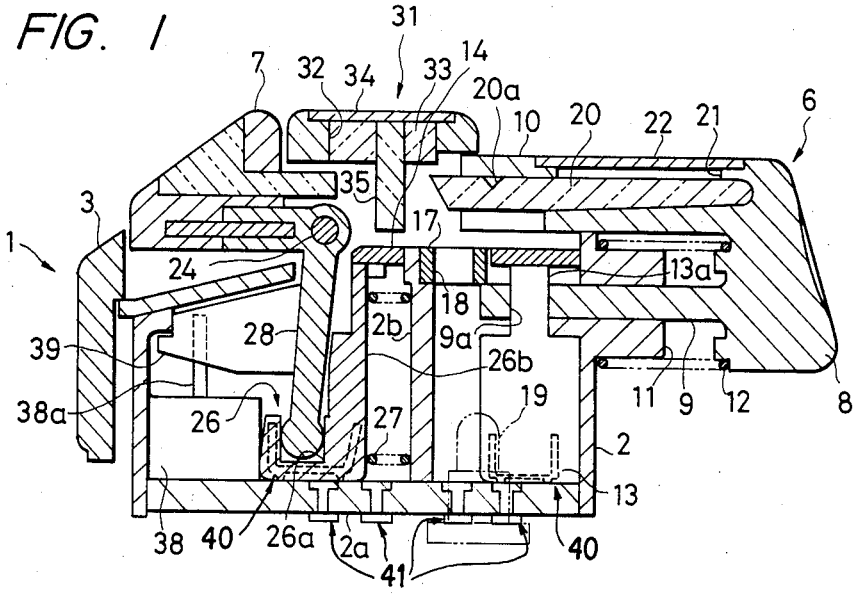
FIG. 1 is a transverse sectional view taken on line I—I of FIG. 2.
Figure 2:
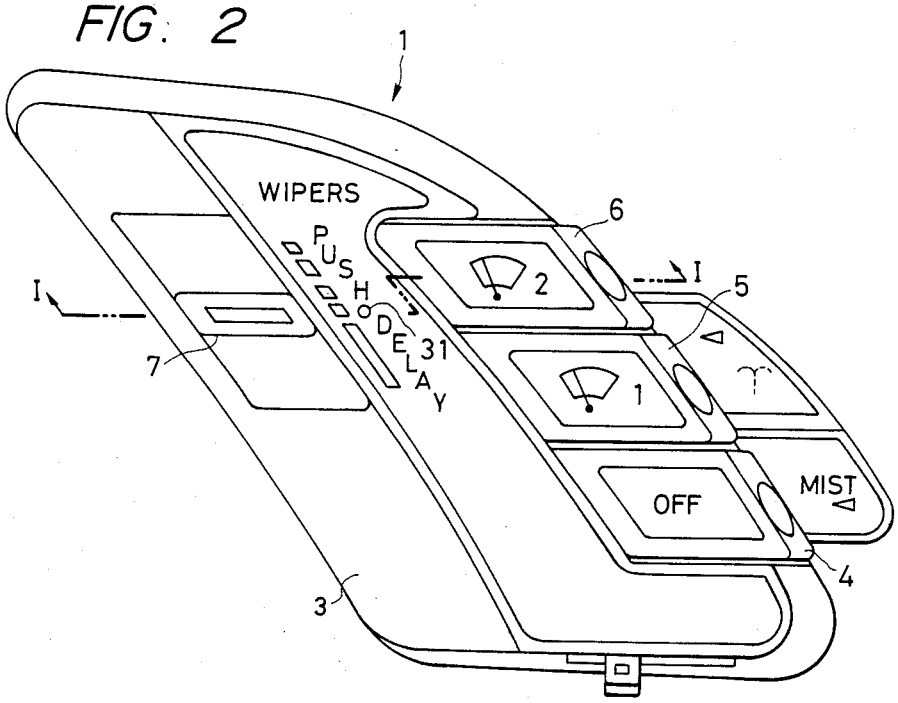
FIG. 2 is an elevational view of the whole body.

In FIGS. 1 and 2, there is shown a wiper switch comprising a switch body 1 formed by covering a switch case 2 with a switch cover 3 and arranged on the right of a steering column (not shown) of a motor vehicle; first through third operating elements 4~6; and an operating know 7 equivalent to a fourth operating element. Of the operating elements, the first through third operating elements 4~6 that can be pressed toward the left are installed vertically in three tiers on the right of the switch case 2, i.e., the operating elements respectively for OFF, low and high wiper operation are arranged in ascending order. On the other hand, the operating knob 7 is installed on the left of the switch body 1 in such a manner that it can be pressed rearward and also moved upward and downward. When the operating knob 7 is pressed rearward, an intermittent wiper is operated and the intermittent time interval can be adjusted by moving the knob upward and downward.

Figure 3:
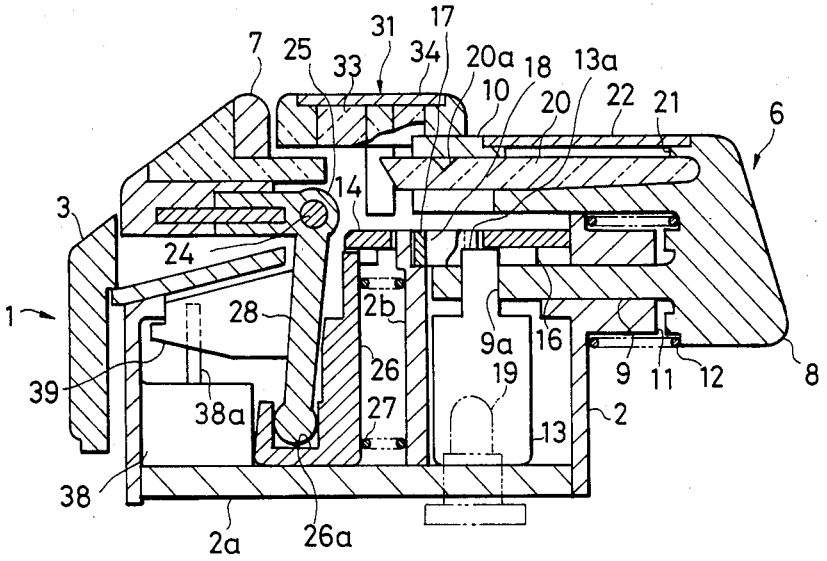
FIG. 3 is a transverse sectional view showing a third operating element held in the depressed state.

The first through third operating elements 4~6 will be described first. As the ways in which the first through third operating elements 4~6 are supported by the switch case 2 are identical, the support structure of the third operating element 6 only will be described by reference to FIG. 1. A mounting lever 9 and a display means 10 are projected from a push means 8 toward the switch case 2 in the third operating element 6, whereas a support tube 11 allowing the mounting lever 9 of the opeating element 6 to pass therethrough is formed in the right-hand wall of the switch case 2. The mounting lever 9 is inserted into the support tube 11 of the switch case 2 to make laterally movable the operating element 6, which is normally energized by a compression spring 12 installed between the push means 8 and the outer wall of the switch case 2 in the direction opposite to which manual pressure is applied, i.e., to the right of FIG. 1. Moreover, a mating hole **9*a* is formed in a position close to the front end of the mounting lever 9 and a mating projection 13*a* projected from the upper end of a contact holder 13 installed movably in the lateral direction of the switch case 2 is fitted into the mating hole 9*a*. A moving contact 40 is arranged on the under surface of the contact holder 13 and a fixed contact 41 corresponding to the moving contact is arranged on an insulator plate 2*a* forming the bottom of the switch case 2. When each of the operating elements 4~6 thus supported by the switch case 2 is pressed against the elastic repulsive force of the compression spring 12, the corresponding contact holder 13 interlockingly moves to the left of FIG. 1 and reaches such a state as shown in FIG. 3**, so that the moving and fixed contacts make contact with each other as prescribed.

Figure 5:
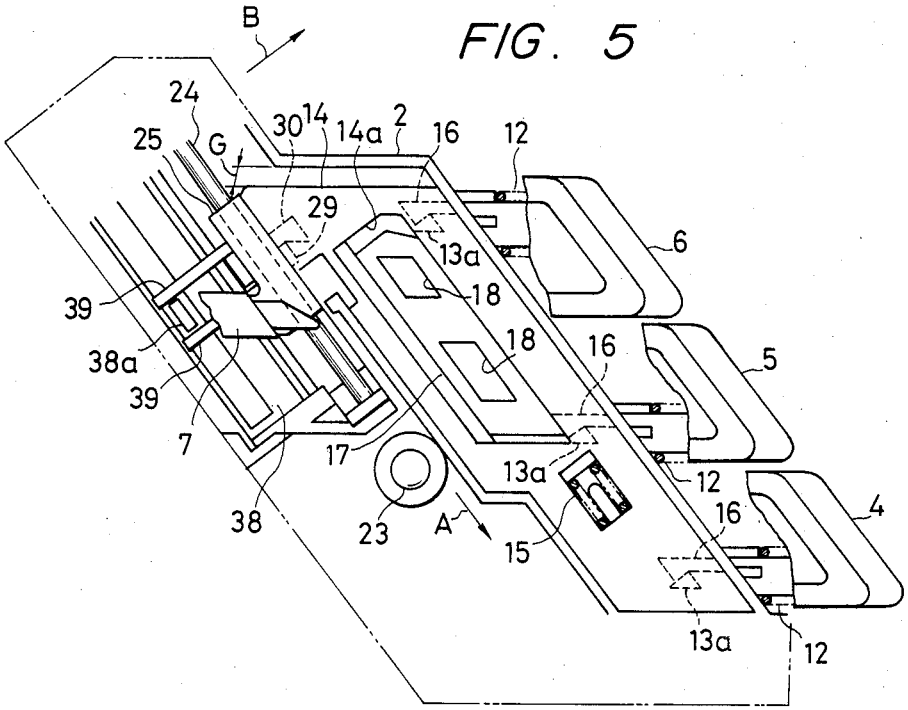
FIG. 5 is an elevational view partly broken away.

Locking construction for holding the depressed operating elements 4~6 will subsequently be described. As shown in FIG. 5, a lock plate 14 located on this side of the mounting lever 9 of each of the operating elements 4~6 is installed in the switch case 2. The lock plate 14 is contained in the switch case 2 with fixed gaps G above and under the plate and made diagonally movable in the vertical direction and normally energized by the compression spring 15 unidirectionally, i.e., in the direction of arrow A (diagonally downward). A mating means 16 is projected from a portion of the rear face of the lock plate 14, the portion thereof corresponding to the front end of each mounting lever 9. The mating projection **13*a* of the contact holder 13 interlocking with each of the operating elements 4~6 is allowed to mate with the mating means 16. In other words, when, e.g., the third operating element 6 is depressed, the contact holder 13 is moved to the left of FIG. 1 and the mating projection 13*a* of the contact holder 13 simultaneously presses the mating means 16** of the lock plate 14, causing the lock plate 14 to move in the direction opposite to arrow A of FIG. 5 (diagonally upward). Then the mating projection 13a of the contact holder 13 passes by the left-hand side of the mating means 16 of the lock plate 14 an the lock plate 14 is simultaneously caused to return in the direction of arrow A by the elastic repulsive force of the compression spring 15. In consequence, the mating projection 13a of the contact holder 13 is prevented by the mating means 16 of the lock plate 14 from returning to the right. The third operating element 6 is thus kept in the depressed position. When either operating element 4 or 5 is depressed while the third operating element 6 is maintained in the depressed position, the mating projection 13a of the contact holder 13 corresponding to the depressed operating element presses the mating means 16 of the lock plate 14 in the direction opposite to which it has been energized, i.e., in the direction opposite to arrow A against the elastic repulsive force of the compression spring 15. Consequently, the mating projection 13a corresponding to the third operating element 6 is unlocked and the third operating element 6 is returned to the original position by the elastic repulsive force of the compression spring 12. A double-push check plate 17 is installed in an opening 14a formed in the lock plate 14 and made diagonally movable in the vertical direction. The length covered by the moving double-push check plate 17 is set slightly greater than the distance between the mating projection 13a of the second operating element 5 and the mating projection 13a of the third operating element 6. When both operating elements 5, 6 are simultaneously operated, accordingly, each of the mating projections 13a, 13a is caused to abut against the double-push check plate 17 and prevent both operating elements 5, 6 from moving in the depressed position. Two circuits corresponding to both operating elements 5, 6 are thus prevented from being simultaneously closed.

Figure 4:
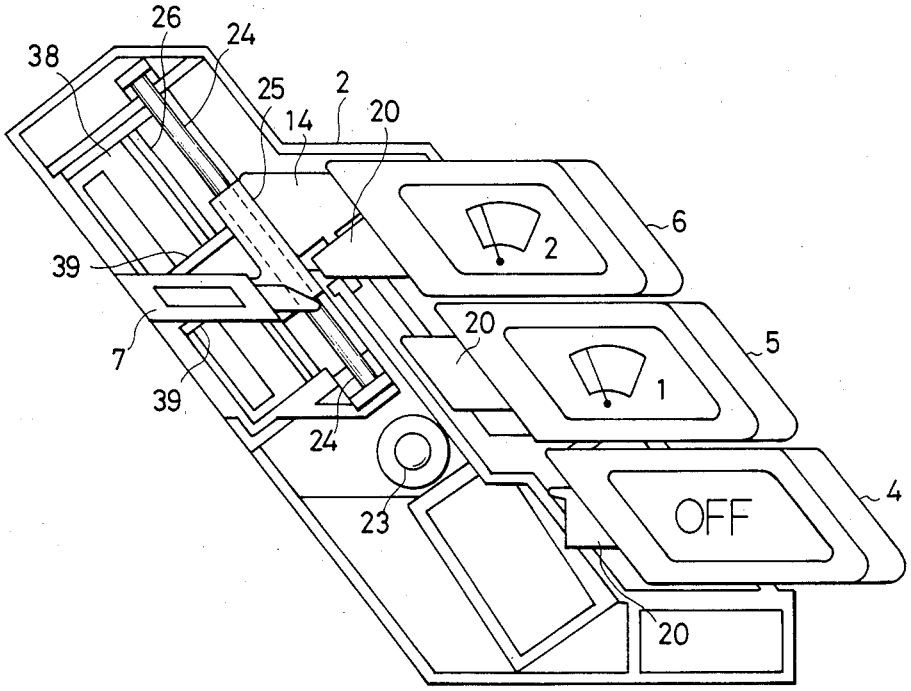
FIG. 4 is an elevational view without a switch cover.

Two through holes 18 are formed in the double-push check plate 17, whereby the light derived from a lamp 19 (see FIG. 1) as a light source in the switch case 2 for providing ON illumination is allowed to penetrate through the holdes. On the other hand, a transparent plastic light guide 20 is inserted into each of the operating elements 4~6 in such a manner as to be buried in the display means 10. The left end of the light guide 20 is projected from each of the operating elements 4~6 and located in front of the double-push check plate 17. An opening 21 is formed in the display means 10 of each of the operating elements 4~6 and a translucent film 22 is stuck in such a manner as to cover the opening 21, which is used as an ON display means as well as a night display means. Of the three light guides 20, those corresponding to the second and third operating elements 5, 6 are respectively provided with V-shaped grooves 20a, 20a in positions located opposite to the through holes 18 of the double-push check plates 17 when the operating elements 5, 6 are put in the depressed position (see FIG. 3). In the switch case 2, moreover, a lamp 23 for night illumination is arranged in the left front position of each light guide 20 (see FIG. 4) and lit simultaneously when a small lamp of the vehicle is lit at night and the lamp 19 for providing night illumination is caused to light when one of the second and third operating elements 5, 6 including the operating knob 7, which will be described later, is depressed. When the lamp 23 for night illumination is lit, the light emitted from the lamp 23 penetrates into each of the three light guides 20 through its front end and illuminates each translucent film 22, thus enabling the user to distinguish the position of each operating element 4~6. When one of the second and third operating elements 5, 6 is depressed, the operating element is moved to the depressed position and light the lamp 19 for ON illumination, whereby the V-shaped groove 20a of the light guide 20 is located opposite to the through hole 18 of the double-push check plate 17. The light sent out of the lamp 19 for ON illumination is reflected from the V-shaped groove 20a and allowed to penetrate into the light guide 20 and illuminate the translucent film 22. In consequence, the user can recognize the ON state of the contact corresponding to the operating element involved. When the operating elements 5, 6 are depressed while the the translucent films 22 of the operating elements 4~6 are illuminated by the lamp 23 for night illumination, the light derived from the lamp 19 for ON illumination is added to the light from the lamp 23 for night illumination and the translucent film 22 is further brighly illuminated, so that the ON state of the contact becomes readily confirmable.

Figure 6:
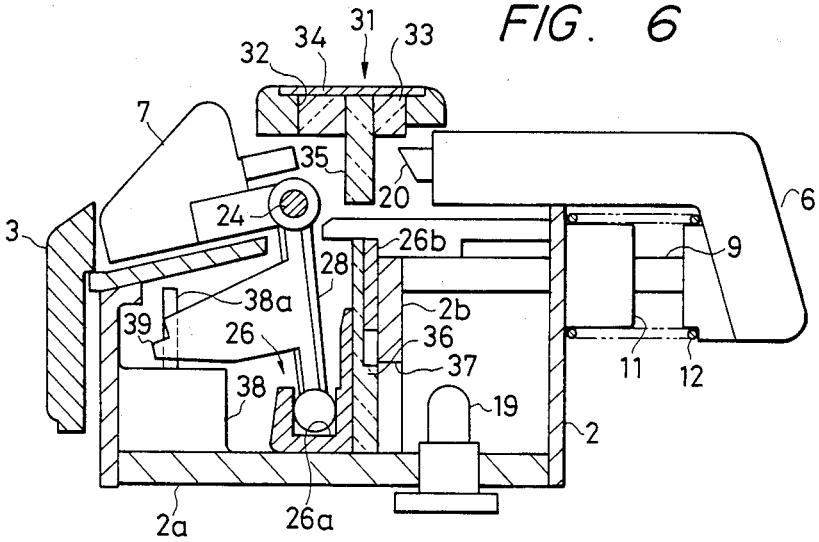
FIG. 6 is a transverse sectional view showing an operating knob in the depressed state.

The peripheral structure of the operating knob 7 will subsequently be described. As shown in FIGS. 1 through 4, a guide shaft 24 is erected diagonally in the vertical direction of the switch case 2. The guide shaft 24 is passed through a support tube 25 so as to support the operating knob 7 movably along and rotatably on the guide shaft 24 thereby. In the switch case 2 is installed a contact holder 26 displaceable in the direction perpendicular to the guide shaft 24, the contact holder 26 being normally energized toward the left of FIG. 1. by a compression spring 27 installed between a vertical partition 2b in the switch case 2 and the contact holder 26. The moving contact 40 is arranged on the under surface of the contact holder 26 in such a manner that it is attachable to and detachable from fixed contact 41 as the contact holder 26 displaces. The operating knob 7 is equipped with an actuating means 28 projected therefrom and extending toward the above contact holder 26, the front end of the actuating means 28 being fitted into a mating groove 26a formed in the contact holder 26. The mating groove 26a extends along the guide shaft 24, thus allowing the operating knob 7 to freely move along the guide shaft 24 and no displacement of the contact holder 26 occurs. However, relative to the swiveling of the operating knob 7 on the guide shaft 24, the displacement of the contact holder 26 from the state shown in FIG. 1 to what is shown in FIG. 6 takes place. As shown in FIG. 5, moreover, a mating projection 29 is projected from the upper end of the side wall 26b of the contact holder 26, whereas a mating means 30 is projected from the lock plate 14 in a position corresponding to the mating projection 29. When the operating knob 7 is depressed and swiveled on the guide shaft 24, the contact holder 26 is displaced in the direction of arrow B of FIG. 5 and the mating projection 29 is caused to press the mating means 30 of the lock plate 14 and move the lock plate 14 in the direction opposite to arrow A. Then the mating projection 29 is allowed to pass by the mating means 30 and the lock plate 14 is moved back by the elastic repulsive force of the compression spring 15 in the direction of arrow A. The mating projection 29 of the contact holder 26 is locked by the mating means 30 of the lock plate 14 and the contact holder 26 is held in a state shown in FIG. 6, whereby the operating knob 7 is held in the depressed position shown therein.

An ON display means 31 for the intermittent wiper as shown in FIG. 2 is installed close to the operating knob 7 on the switch cover 3 and, as shown in FIG. 1, a transparent plastic light guide 33 is provided in an opening 32 formed in a fixed position of the switch cover 3 and a translucent film 34 is stuck on the surface of the light guide 33 provided with a light guide pin 35 equivalent to a light receiving means, the light guide pin 35 being fitted in a fixed position of the light guide 33 with the bottom up. On the other hand, a vertically extended light guide 36 is buried in and fixed to the side wall **26*b* of the contact holder 26 (see FIG. 6). The light guide 36 having the exposed lower end portion is located opposite to a through hole 37 formed in the partition 2*b* of the switch case 2, whereas its upper end portion is upwardly exposed. When the operating knob 7 is depressed to cause the contact holder 26 to displace toward the right as shown in FIG. 6, the lower end portion of the light guide 36 of the contact holder 26 communicates with the through hole 37 of the partition 2*b*, whereas the upper end portion fo the light guide 36 is located right under the light guide pin 35. The light derived from the lamp 19 for ON illumination is passed through the through hole 37 and irradiates the light guide pin 35 through the light guide 36 of the contact holder 26 and illuminates the translucent film 34 of the ON display means 31. The user can thus confirm the ON operation executed. The light guide 33 is provided with a light receiving means (not shown) projected therefrom in the position opposite to the lamp 23 for night illumination and not only the light guide 33 but also the translucent film 34 is illuminated by the lamp 23** when it is lit.

A linearly operating variable resistor 38 shown in FIG. 1 is fixed to the switch case 2 with its turned-up operating element **38*a* and linearly operable along the extension of the guide shaft 24. The operating knob 7 incorporates a pair of coupling pieces 39, 39 projecting from its actuating means 28 and mates the operating element 38*a* with the projected coupling pieces 39 by positioning the operating element 38*a* of the variable resistor 38 between the projected coupling pieces 39. When the operating knob 7 is moved along the guide shaft 24, the operating element 38*a* of the variable resistor 38 is moved ot make variable the resistance of the variable resistor 38**, whereby the intermittent time interval at which the intermittent wiper is operated can be adjusted.

When one of the first through third operating elements 4~6 is pressed toward the left in the switching device thus constructed, the mating projection **13*a* of the contact holder 13 is caused to press the mating means 16 of the lock plate 14 interlockingly and move the lock plate 14 tentatively in the direction opposite to arrow A of FIG. 5, so that the mating means 16 is allowed to mate with the mating projection 13*a*. The operating element is thus held in the depressed position. When the operating knob 7 is pressed rearward, the mating projection 29 of the contact holder 26 is interlockingly displaced in the direction of arrow B of FIG. 5 and the mating projection 29 of the contact holder 26 is accordingly caused to press the mating means 30 of the lock plate 14 and move the lock plate 14 tentatively in the direction opposite to arrow A. In consequence, the operating knob 7 is held in the depressed position since the mating projection 29 mates with the mating means 30. When the operating knob 7 is depressed while one of the first through third operating elements 4~6 is held in the depressed position, the lock plate 14 is moved in the direction opposite to arrow A and unlock the operating element thereof. As a result, the operating element returns to the original position. When one of the first through third operating elements 4~6 is depressed while the operating knob 7 is held in the depressed position, on the contrary, the lock plate 14 is moved in the direction opposite to arrow A and the operating knob 7** is unlocked and allowed to return to the original position.

While one of the first through third operating elements 4~6 including the operating knob 7 is thus locked by the single lock plate 14, these operating elements can be operated in different directions, respectively. The operating elements 4~6 are accordingly prevented from becoming lengthy in the direction in which they are lined up and the whole body can be made compact thereby. In addition, the operability of such a switching device is improvable to a large extent since the first through third operating elements installed on the right of the switch body 1 are operated toward the left and the operating knob 7 installed on the left of the switch body 1 is pressed rearward.

Although the operating knob 7 was so arranged as to be pressed rearward according to the above embodiment, the press-operation according to the present invention is not limited to what has been above prescribed and the operating knob 7 may be pressed toward the right. The result is that the intended purpose of the present invention will readily be achievable, provided the operating knob is operable in a direction different from the direction in which the other operating elements are operated.

As set forth above, the switching device according to the present invention is characterized in that one of the operating elements can be depressed in a direction different from the direction in which the other elements are depressed and each operating element is locked by the single lock plate normally energized unidirectionally. Consequently, the switching device according to the present invention can be made compact even if the number of operating elements is increased and the improvement of its operability is still ensured thereby.

What is claimed is:

1. A switching device comprising:

a plurality of first operating elements;

a first mounting means supporting said plurality of first operating elements for axial movement linearly in opposite directions along respective spaced parallel axes, to first and second operating positions;

a second operating element;

second mounting means supporting said second operating element for swiveling movement in opposite directions about an axis to a first and second operating position;

a fixed contact corresponding to each of a plurality of first electrical contacts;

a contact holder, including one of said first electrical contacts, for each of said first and second operating elements, each said contact holder being disposed to slidably move in first and second opposite directions in response to movement of said respective first and second operating element for bringing said associated electrical contact into and out of physical engagement with said corresponding fixed contact; and a lock plate common to said first and second contact holders mounted adjacent said contact holders for sliding movement in opposite directions perpendicular to the sliding movement of said contact holders;

said lock plate including mating means for engaging a respective contact holder for locking the associated electrical contact into physical engagement with said corresponding fixed contact upon movement of any one of said first and second operating elements to said second position, said mating means being operative to release said contact holder for unlocking the respective locked first electrical contacts upon movement of any one of said plurality of said first and second operating elements, other than the operating element for the contact holder including the locked first electrical contact, to said second position.

* * * * *